United States Patent [19]

Atkins et al.

[11] Patent Number: 4,457,122

[45] Date of Patent: Jul. 3, 1984

[54] VACUUM PACKAGING GOODS IN HEAT SHRINKABLE PLASTIC BAGS USING FLEXIBLE DIAPHRAGMS

[75] Inventors: J. Harell Atkins, Duncan; Joseph E. Owensby, Spartanburg, both of S.C.

[73] Assignee: W. R. Grace & Co., Cryovac Div., Conn.

[21] Appl. No.: 295,155

[22] Filed: Aug. 21, 1981

[51] Int. Cl.[3] ..... B65B 31/02

[52] U.S. Cl. ..... 53/434; 53/512; 53/442; 53/557

[58] Field of Search ..... 53/434, 442, 512, 557

[56] References Cited

U.S. PATENT DOCUMENTS

| | | | |
|---|---|---|---|
| 2,681,757 | 6/1954 | Kellersman | 53/434 |
| 3,113,874 | 12/1963 | Baush et al. | 53/442 |
| 3,120,728 | 2/1964 | Snow, Jr. et al. | 53/557 |
| 3,171,238 | 3/1965 | Dreyfus | 53/442 |
| 3,470,673 | 10/1969 | Tipper | 53/512 |
| 3,471,990 | 10/1969 | Bonuchi et al. | 53/512 |
| 3,511,021 | 5/1970 | Lyon et al. | 53/512 |
| 3,619,974 | 11/1971 | Kupcikevicius | 53/512 |
| 4,132,048 | 1/1979 | Day | 53/434 |
| 4,182,095 | 1/1980 | Day | 53/512 |

FOREIGN PATENT DOCUMENTS

| | | | |
|---|---|---|---|
| 934717 | 10/1973 | Canada . | |
| 291841 | of 1971 | U.S.S.R. | 53/512 |

*Primary Examiner*—Kuang Y. Lin
*Assistant Examiner*—Kurt Rowan
*Attorney, Agent, or Firm*—John J. Toney; William D. Lee, Jr.; Joseph P. Harps

[57] ABSTRACT

A method and apparatus for vacuum packaging goods in heat shrinkable, thermoplastic bags in a vacuum chamber equipped with flexible, heated diaphragms that can be collapsed upon a filled bag to heat it to shrinking temperature.

15 Claims, 5 Drawing Figures

VACUUM PACKAGING GOODS IN HEAT SHRINKABLE PLASTIC BAGS USING FLEXIBLE DIAPHRAGMS

FIELD OF THE INVENTION

This invention relates to method and apparatus for packaging goods. Particularly, it pertains to vacuum packaging food in heat shrinkable plastic bags.

BACKGROUND

A patent, somewhat related to the present invention, is U.S. Pat. No. 4,132,048, which was issued to T. T. Day on Jan. 2, 1979. In the Day patent, which is owned by W. R. Grace & Co., the assignee of the present invention, the bag inside the chamber and the chamber are both evacuated to a relatively low reduced pressure, at which time the bag is sealed inside the chamber. Continued evacuation of the air in the chamber outside the bag caused the bag to balloon out due to residual air pressure therein, at which time it is heated by heaters on the inside of the chamber. The chamber is then vented in a controlled manner to aid in controlling the heat caused shrinkage of the bag onto the food product.

The Day apparatus and process operates well, but the present invention offers distinctions and additional advantages. Among these advantages are that the shrinking of the bag is controlled better. For example, as the bag is heated to a temperature at which the plastic of the bag material begins shrinking, the bag will commence shrinking regardless of whether or not that is the most opportune time with respect to the degree of evacuation of the surrounding chamber. In the present invention, the diaphragms control the start of shrinkage of the bag, and they are fully controllable.

Both the present invention and the apparatus of the above mentioned Day patent overcome numerous problems present in the prior art of hot water systems. It has been heretofore known to use pre-formed packaging such as bags for relatively large meat products such as whole rounds of beef or whole pork loins, but the art heretofore has been to shrink these bags using hot water. There are many disadvantages with hot water systems, including very poor utilization of the energy in the hot water (it has been estimated that as low as 3% of the heat energy in the water goes into the useful work of bag shrinkage, and the rest is wasted). In addition, handling of the hot water itself is a great problem since the work is done in meat packing cold rooms. These cold rooms consume enormous amounts of energy to keep them refrigerated and thus floor space is very valuable. The present invention is to a dry process, which saves all of the sloppiness and mess and safety hazards associated with water getting on the floor, and in addition it utilizes much less valuable floor space than is utilized by hot water systems.

An important advantage of the present invention resides in the provision of flexible diaphragms inside the heated platens inside the vacuum chamber. These diaphragms accomodate many difference sizes and shapes of goods, and deliver heat to all of them, as needed. The platens heat the diaphragms and the diaphragms deliver that heat to the heat shrinkable bag, and only to the bag by contact, which automatically accomodates difference sizes and shapes of products.

The invention also operates on a shorter time cycle because it does not need as low a vacuum pressure as some prior art systems, and that achieves important advantages over the prior art.

Another advantage of the present invention's flexible heated diaphragms is that difference sizes and shapes of food products or other goods can be accommodated in one machine with no changes to the machine. In the real world of food packaging, it is unlikely that a plant which packages large cuts of beef would also package processed meat products such as salami or balogna. However, there are many different sizes and shapes of large cuts of beef and there are many different sizes of salami shaped products. Thus, the invention's heated flexble diaphragms produce important advantages over the prior art in general.

Another advantage of the invention is that when necessary a rack can be utilized in the chamber between the lower heated diaphragm and the meat product with the bag resting thereon. By controlling the size and the spacing of the wires or other material making up the rack, the amount of heat imparted to the product by the heated diaphragms can be controlled. This is important with certain products, such as certain cheeses and certain processed foods, wherein more than a predetermined small amount of heat would be unacceptable.

Another advantageous feature of the invention resides in an optional closing bar, which further improves the operation of the invention method by causing the bag to balloon out towards the diaphragms before the diaphragms contact the bag, to thus improve the shrink and the quality of the final package.

DESCRIPTION OF THE DRAWINGS

The above and other advantages of the invention will be pointed out or will become evident in the following detailed description and claims, and in the accompanying drawing also forming a part of the disclosure, in which:

SUMMARY OF THE INVENTION

Figure 1:
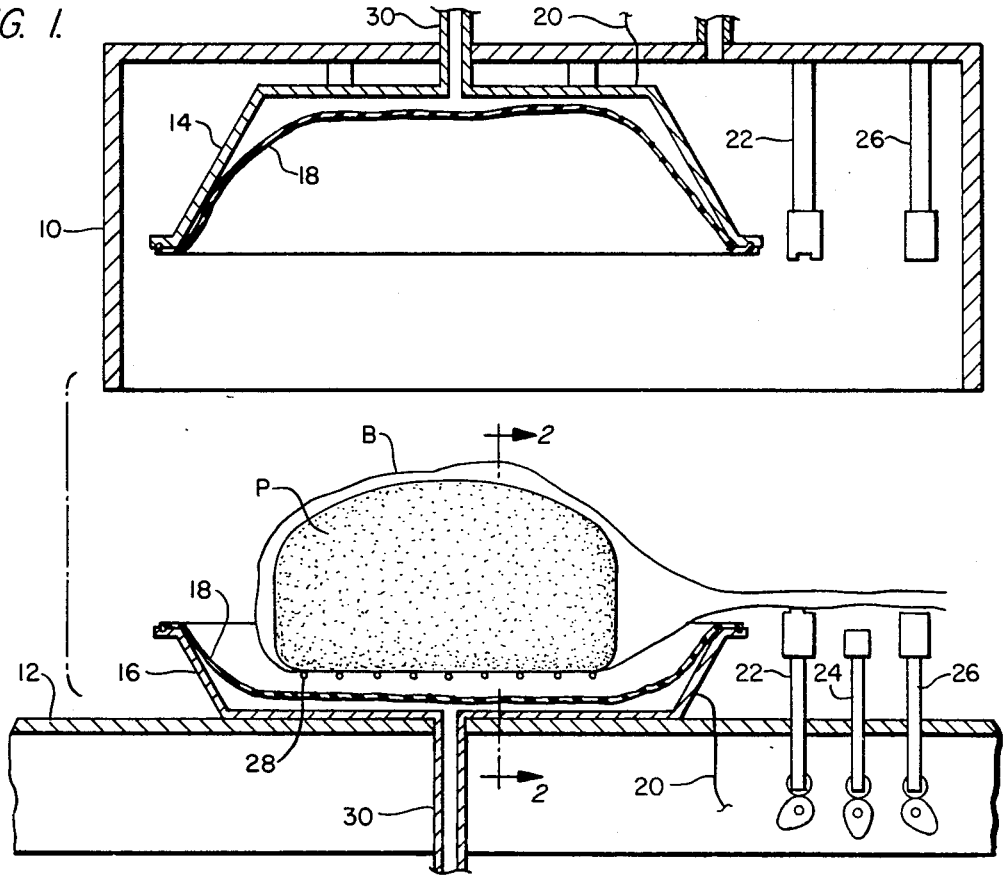
FIGS. 1,3 and 4 are a series of views illustrating the method of the invention.

In one aspect the invention is a method of vacuum packaging goods in heat shrinkable thermoplastic bags comprising the steps of loading a product into a heat shrinkable bag, contacting the bag with a flexible, heated diaphragm to shrink cause the bag to shrink and evacuating and sealing the bag. Evacuation can take place before, during or after the bag is contacted by the diaphragms.

In another aspect the present invention is a method of vacuum packing goods pre-loaded into a heat shrinkable bag comprising the steps of (a) providing diaphragm means which can be heated and which are operatively cooperable with said bagged goods, said diaphragm means being adapted to deliver heat to said bagged goods; (b) providing means to heat said diaphragm; (c) heating said diaphragm; (d) evacuating the air from inside said bag; (e) collapsing said diaphragm means onto said bagged goods to cause the heat in said diaphragm means to cause the bag to shink onto said goods, and, (f) closing and sealing the bag.

In yet another aspect the present invention is a machine for vacuum packaging goods of the type wherein the goods are pre-loaded into heat shrinkable bags, said machine comprising a vacuum chamber to vacuumize the bagged goods, the improvement comprising diaphragm means in said chamber of a size and shape sufficiently large to accommodate the largest goods to be packaged in the machine, heating means to heat said diaphragm means, means to control the motion of said diaphragm means with respect to said goods and the respective associated platen, and said diaphragm means consisting essentially of material adapted to transfer sufficient heat to the bagged goods to shrink the bag onto the goods.

DETAILED DESCRIPTION

Referring now in detail to the drawings, FIGS. 1 through 4 show apparatus comprising an outer vacuum chamber made up of a top 10 and a base 12. Other means not shown are provided to form air tight seals and the like as needed, all as is well known to those skilled in these arts. An upper platen 14 is mounted in the top 10, and a lower platen 16 is mounted on base 12. Mounting means, which may comprise yokes, nuts and bolts and the like, are provided to removably mount the platens 14 and 16, and these means also permit interchanging of the platens, as is also well known to those skilled in these arts.

Figure 2:
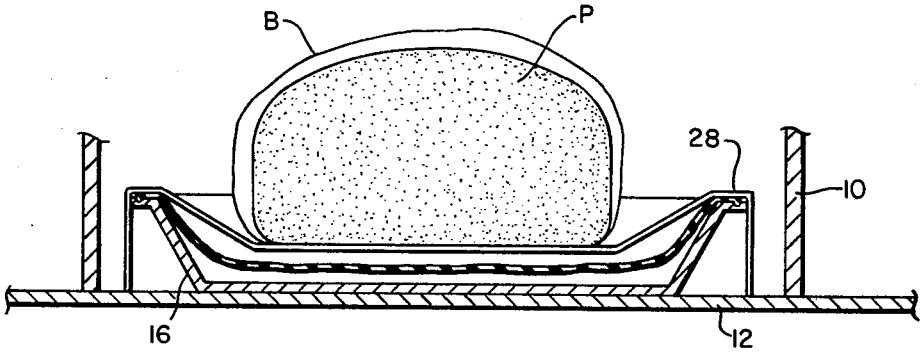
FIG. 2 is a cross-sectional view taken on line 2—2 of FIG. 1 showing the manner of supporting the rack.

By way of example, the drawings show a product "P" which has been pre-packaged into a bag "B" and has been put inside the chamber. A rack 28 is provided on which the product "P" rests. FIG. 2 shows how the rack simply rests on base 12 and is shaped to fit inside the lower platen 16. The rack is an optional feature, as explained below, and other sizes, shapes and types of racks can, of course, also be used.

The primary improvement of the invention resides in a pair of identical diaphragms 18, which are fixed to the lips of the upper and lower platens 14 and 16 as indicated in the drawings. Diaphragms are a well-developed art. A suitable flexible rubber or rubber-like material will be selected, based on its ability to withstand repeated flexing, contact with the food product and the rack 28, and its ability to transmit heat from the heated platens 14 and 16 to the food product. These are the main criteria in selecting the material for the diaphragms 18. As shown in the drawings, the upper diaphragm appears slightly larger than the lower, and the diaphragms can be the same or different, as a matter of design choice.

Figure 3:
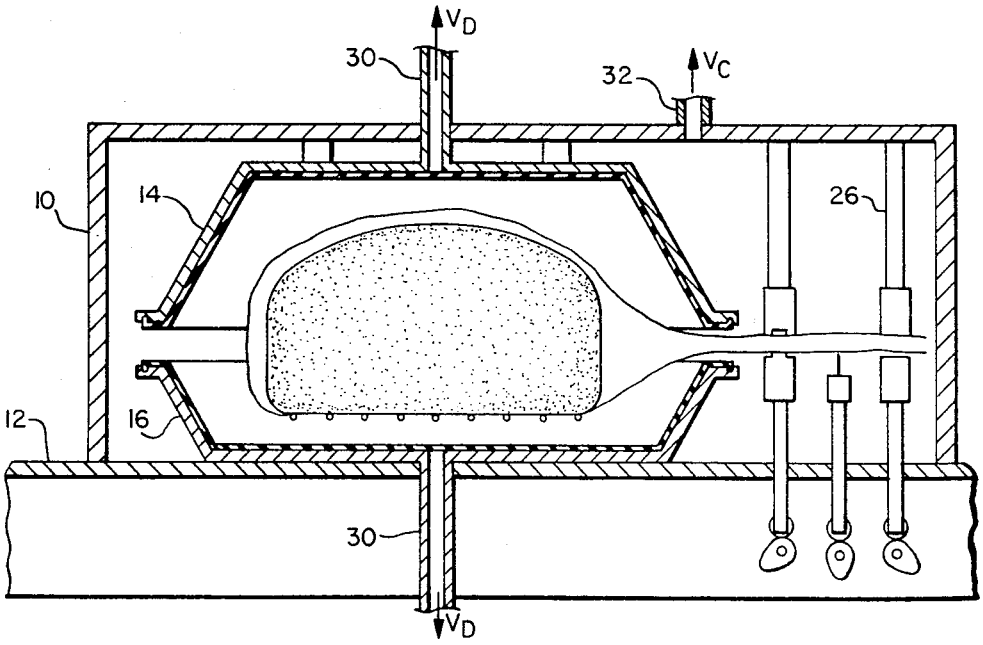
Figure 4:
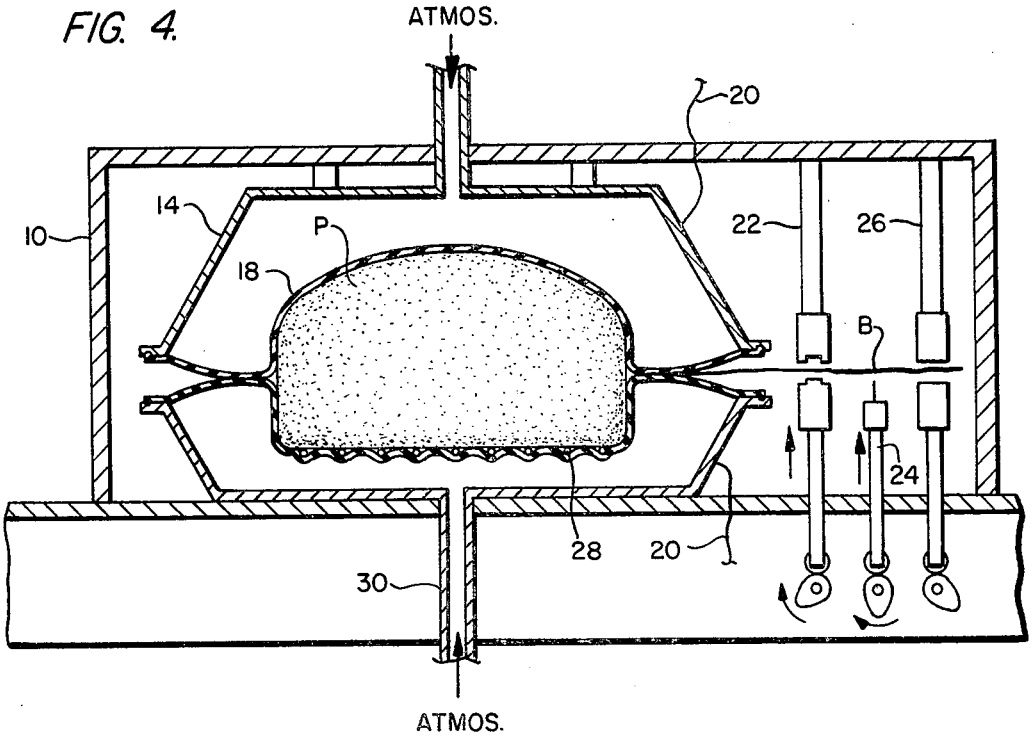

In addition to heating the diaphragms, means are provided to control their motion towards and away from the food product and to hold them in contact with the heated platens. To this end, conduits 30 extend to the upper and lower platens and are connected to a vacuum pump to withdraw the air from between each diaphragm and its platen. This pressure is called $V_D$. As is quite clearly apparent from the FIGS. 1 and 2, when $V_D$ is applied, the diaphragms expand out into contact with the platens, as shown in FIG. 3. When this pressure is relieved, as indicated in FIG. 4, then the diaphragms collapse onto the product "P". Means are also provided for chamber vacuumization and pressure. Another pipe 32 is provided, and the vacuumizing pressure $V_C$ is supplied to the system through this pipe 32.

As is well-known to those skilled in the art, the machine shown in the drawings can be associated with two separate vacuumizing systems, or with a single system having a three-way valve to direct the vacuum pressure to one, both, or neither of the two pipes 30 and 32. In any case, those skilled in this art know how to provide the vacuum pressures $V_C$ and $V_D$ to the pipes 30 and 32 respectively, in order to control the motion of the diaphragms and to vacuum-pack the product "P", as set forth in the method described below. FIG. 4 shows how the diaphragms are collapsed down onto the bagged product at the final step of the packaging, again as will be explained with respect to the method below.

The rack 28 will create an unheated section in the bag but will also control the heating of the food product "P" resting thereon. With, for example, cheese and certain other foods, heat must be very closely controlled or the product's esthetics or even its fitness as food can be adversely affected. The invention contemplates using racks of different sizes and shapes as needed to control the degree to which the food product is heated by contact with the heated lower diaphragm. For example, if the bars or other elements used to fabricate rack 28 were made thicker and/or positioned closer together, then the food product resting thereon would be heated less by the heat from the lower diaphragm. However, a concurrent disadvantage is that that portion of the bag on the rack is not heated as much as other portions of the bag. This will cause an irregularity in the manner in which the bag shrinks around the product, as is explained below, but which is not a serious problem. With many products, the rack can be omitted and the product put directly on the lower heated diaphragm.

It is anticipated that this problem can be overcome in a number of ways. Firstly, for certain products, this irregular area may not matter, i.e., products which have top and bottom surfaces. For example, if a quantity of chicken parts were to be shrink wrapped on a flat tray or the like, the underside of the tray or the like does not matter, and its contact with the rack and any resultant irregularity of the shrink has no effect. However, in some products this could make a difference, i.e., whole poultry. This problem can be overcome, as one possible solution, by providing a very large degree of shrink. That is, if the various parameters of the bag before and after shrinking are controlled such that the bag will have to shrink a great deal, then this large amount of shrinkage can literally "overpower+ any possible irregularity created by the rack.

Thus, the advantage of controlling the heat imparted to the food so that no adverse effect is experienced by the food is obtained. Any problem of irregular shrink of the bag, if there is any, is overcome using other aspects of the teaching of the invention.

In general, the present invention provides an adequate package as to wrinkling and uniform fitting of the bag onto the goods, but, primarily, it solves problems in the prior art of limitations on the size of the goods relative to the chamber size which can be accommodated, i.e., it imparts great versatility as to sizes and shapes of goods which can be packaged in a single machine.

The bag may be made of any suitable packaging material including but not limited to thermal plastics such as polyethylene, cross-linked ethylene, polypropylene, saran, ethylene vinyl alcohol copolymers, nylon, polyvinyl fluoride, and the like, and laminates of these materials. Of couse, other materials known to those skilled in the art can also be used.

It is conventional in this art to provide means inside the vacuum chamber to close, to seal, and to cut off excess bag material outboard of the seal. These means are well developed and generally well known, and are indicated herein by sealing means 22, cut-off means 24, and means 26 having the ability to close the bag in an air tight manner, but not seal the bag, to later re-open the bag, and still later to permit sealing the bag using means 22.

Means, indicated by wire 20 connected to the two platens, are provided to heat the upper and lower platens 14 and 16. Heating of platens is known in this art, reference may be had to the Day patent referenced above as needed. Sufficient to say that the heating means deliver enough heat via the diaphragms to shrink the bag. The heat may be most conveniently supplied by electrical resistance means as is well known. While this is the preferred method of heating the platens which in turn heat the diaphragms, the platens, in an alternate embodiment could be eliminated and the diaphragms heated by an electrical resistance such as a mesh of flexible wires or strips.

The method of the invention comprises the following steps, which will be accompanied by references to the drawings as they appear in the sequence of steps.

In general, the method of the invention is to package products and bags smaller than the maximum capacity of the platens 14 and 16. The advantage resides in the fact that the bagged products can range from considerably smaller than, up to the full capacity of the maximum possible with any particular pair of platens 14 and 16. The diaphragms are preheated by being drawn out into contact with the platens, and then drawn in due to the vacuum conditions inside the machine in general onto the bagged product, to thus heat the bag and cause it to shrink down onto the product. An optional feature is that the clamp or seal bar 26 can be used to first balloon out the bag before the diaphragms come in onto it, to thus improve the manner in which the heated diaphragms cause the bag to shrink.

More in particular, the method steps are:

(1) The preloaded bag "B" with the product "P" is placed on the rack 28 in the open machine, with the mouth of the bag positioned over the closing sealing and cutting means 22, 24 and 26. This is shown in FIG. 1.

(2) The machine is closed onto the bag, and $V_D$ is applied to draw the diaphragm 18 out into contact with the platens 14 and 16. ($V_D$ may remain applied when the chamber is open, if desired. In the alternative, the platen heaters can remain heated.)

(3) The platen heaters are activated to begin heating.

(4) Vacuum pressure $V_C$ is applied to the chamber 10–12 to evacuate the air from inside and outside the bag. This is shown in FIG. 2.

Figure 5:
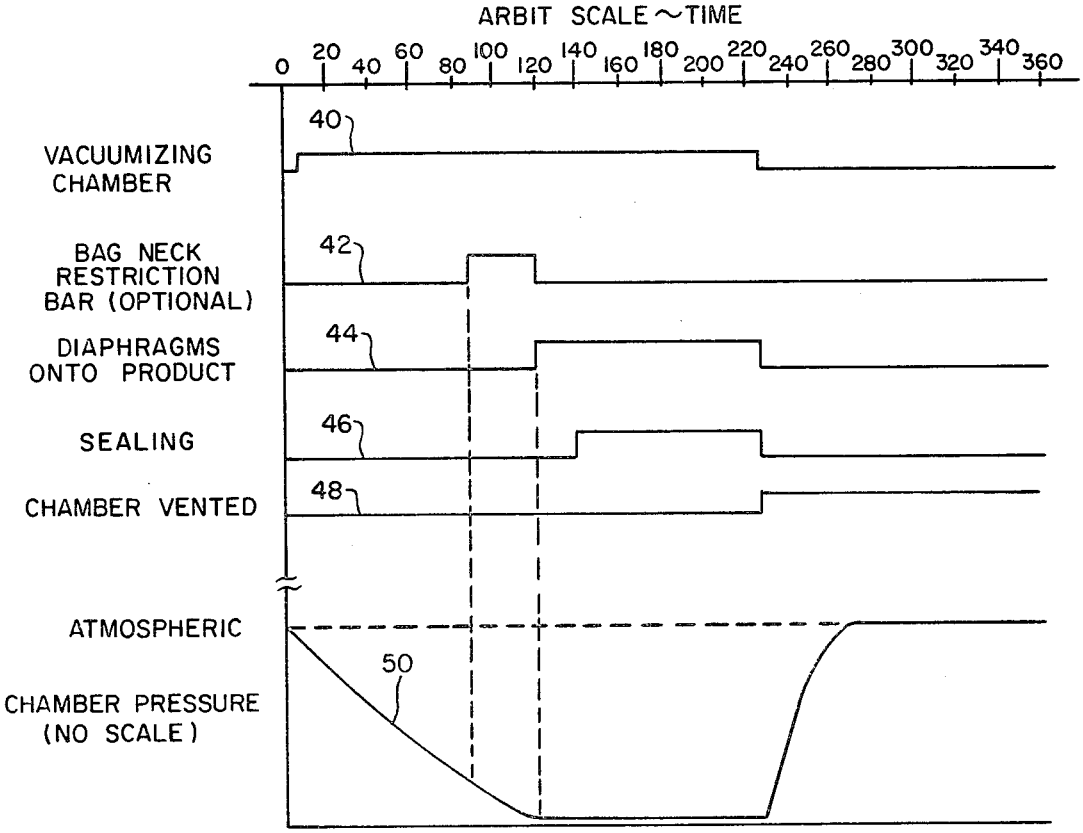
FIG. 5 is a timing chart showing the method.

(5) As an option, while the evacuation by $V_C$ is continuing, near the end of that cycle, the retaining or restriction bar 26 can be closed down onto the bag for a relatively short period of time to cause the bag to balloon out. This condition is shown in FIG. 5 on timing bar line 42. The scale 0 to 360 along the top of FIG. 5 is an arbitrary set of numbers to indicate relative interactions of the various events. The bag restriction bar is indicated by line 42, and the fact that it occurs during the vacuumizing of the chamber on the line 40 is evident.

(6) $V_C$ evacuates the chamber and the bag to the same vacuum pressure. This can be momentarily, as is clear from FIG. 5 when the clamp bar option is used.

(7) The vacuum pressure $V_D$ on the diaphragms is released or vented to atmosphere while the vacuum pressure in the chamber $V_C$ continues. This causes collapse and shrinkage of the bag driven by the hot diaphragms onto the product, and is the condition shown in FIG. 4. The rack 28 is, of course, between the diaphragm and the bag.

(8) The bag is then permanently sealed or clipped shut using means 22, and the excess bag material is cut off by means 24. (Preferably, final sealing occurs shortly after the chamber reaches the desired pressure). Clipping means are well known in this art, see U.S. Pat. No. 3,832,824 to Burrell assigned to the same assignee as the present invention, for example.

(9) $V_C$ is turned off and the chamber vented to the atmosphere which causes an additional final tight collapse of the bag onto the product.

(10) The chamber is opened and package is removed.

The line 46 indicates the operation of the sealing means 22, and the line 50 shows the effect of $V_C$ between atmosphere and the vacuumizing pressure, as indicated by line 50.

The word "platen" as used in the specification and claims herein shall be understood to include various sizes and shapes of such means useful in the invention and not be limited to flat devices as the word is sometimes defined in dictionaries.

While the invention has been described in detail above, it is to be understood that this detailed description is by way of example only, and the protection granted is to be limited only within the spirit of the invention and the scope of the following claims.

We claim:

1. A method of vacuum packing goods pre-loaded into a heat shrinkable bag and heat shrinking the bag comprising the steps of (a) providing flexible diaphragm means which can be heated and which are operatively co-operable with said bagged goods, said diaphragm means being adapted to deliver heat to said bag; (b) providing platen means substantially surrounding but defining a space larger than the bagged goods, said platen means including means to heat said diaphragm means; (c) heating said diaphragm out of contact with said bag by bringing said diaphragm means into contact with said platen means; (d) evacuating the air from inside said bag; (e) collapsing said heated diaphragm into contact with the bag to heat and to shrink the bag onto said goods; (f) and, closing and sealing the evacuated bag.

2. The method of claim 1 and the additional step of locating the bagged goods in a vacuum chamber to thereby evacuate the air from both inside and outside the bag, and temporarily closing the bag while performing said evacuating step to cause the bag to ballon out towards said diaphragm means prior to said step of collapsing said diaphragm means onto said bag.

3. The method of claim 1, and providing a predetermined size and shape of said platen means and of said diaphragm means adapted to cooperate with the maximum of the particular shape of the goods and of the bags being packed.

4. The method of claim 3, wherein the method is carried out by and in a vacuum packing machine, and selecting a removably mounted heated diaphragm and cooperative platen of a size and shape to permit packaging of different sizes and shapes of goods and of bags.

5. The method of claim 3, including the step of providing heated diaphragm means to support the goods thereon, whereby the amount of heat imparted to the goods from said heated diaphragm means can be controlled.

6. The method of claim 1, wherein said step of bringing said diaphragm in contact with said heated platen means comprises means to permit evacuation of the space between said platen means and said diaphragm means.

7. The method of claim 1, wherein said step of closing and sealing the bag comprises the use of means to heat seal the bag.

8. In a machine for vacuum packaging goods of the type wherein the goods are pre-loaded into heat shrinkable bags, said machine comprising a vacuum chamber to vacuumize the bags, the improvement comprising: diaphragm means in said chamber of a size and shape sufficiently large to accommodate the largest goods to be packaged in the machine; platen means which include heating means to heat said platen and consequently heat said diaphragm means by contact therewith, said diaphragm means being substantially enclosed by said platen means and consisting essentially of material adapted to transfer sufficient heat to the bag to shrink it onto the goods; and, vacuum means to create alternate pressure differentials across said diaphragm whereby said diaphragm means can be drawn into contact with said platen means and then the thus heated diaphragm can be collapsed upon said bag.

9. The combination of claim 8, wherein said platens comprise upper and lower platens, and including rack means operatively cooperable with said lower platen to support the goods out of contact with said lower platen, said rack means being so configured as to control the heat from said diaphragm imparted to the goods resting on said rack means.

10. The combination of claim 8, including means to heat seal the bag in said vacuum chamber.

11. The combination of claim 8, including closure means in said chamber adapted to close but not seal said bag, whereby the bag may be caused to balloon out towards said heated diaphragm means to improve the shrink and fit of the bag onto the good in the resultant package.

12. The combination of claim 8, including means in said chamber to heat seal the bag.

13. The method of claim 1 wherein step (d) is performed before step (e).

14. The method of claim 1 wherein step (d) is performed after step (e).

15. The method of claim 1 wherein step (e) is performed while step (e) is being performed.

* * * * *